US007672836B2

(12) United States Patent
Lee et al.

(10) Patent No.: US 7,672,836 B2
(45) Date of Patent: Mar. 2, 2010

(54) METHOD AND APPARATUS FOR ESTIMATING PITCH OF SIGNAL

(75) Inventors: Yongbeom Lee, Seoul (KR); Yuan Yuan Shi, Beijing (CN); Jaewon Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 786 days.

(21) Appl. No.: 11/247,277

(22) Filed: Oct. 12, 2005

(65) Prior Publication Data

US 2006/0080088 A1 Apr. 13, 2006

(30) Foreign Application Priority Data

Oct. 12, 2004 (KR) ..... 10-2004-0081343

(51) Int. Cl.
*G10L 11/04* (2006.01)

(52) U.S. Cl. ..... 704/207; 704/217

(58) Field of Classification Search ..... 704/207, 704/223

See application file for complete search history.

(56) References Cited

U.S. PATENT DOCUMENTS 4,696,038 A * 9/1987 Doddington et al. ..... 704/219
4,731,846 A * 3/1988 Secrest et al. ..... 704/207
5,208,861 A * 5/1993 Fujii ..... 704/208
5,321,636 A * 6/1994 Beerends ..... 702/76
5,930,747 A * 7/1999 Iijima et al. ..... 704/207
5,946,650 A * 8/1999 Wei ..... 704/207
6,035,271 A * 3/2000 Chen ..... 704/207
6,064,958 A * 5/2000 Takahashi et al. ..... 704/243
6,141,641 A * 10/2000 Hwang et al. ..... 704/243
6,226,606 B1 * 5/2001 Acero et al. ..... 704/218
6,418,407 B1 * 7/2002 Huang et al. ..... 704/207
6,507,814 B1 * 1/2003 Gao ..... 704/220
6,526,379 B1 * 2/2003 Rigazio et al. ..... 704/245
6,885,986 B1 * 4/2005 Gigi ..... 704/207
6,917,912 B2 * 7/2005 Chang et al. ..... 704/207
2003/0093265 A1 * 5/2003 Xu et al. ..... 704/208
2004/0158462 A1 * 8/2004 Rutledge et al. ..... 704/207

OTHER PUBLICATIONS

Boersma "Accurate short-term analysis of fundamental frequency and the harmonics-to-noise ration of a sampled sound", Proceeding 17, University of Amsterdam, 1993.*

(Continued)

*Primary Examiner*—Richemond Dorvil
*Assistant Examiner*—Jialong He

(57) ABSTRACT

A pitch estimating method and apparatus in which mixture Gaussian distributions based on candidate pitches having high period estimating values are generated, a mixture Gaussian distribution having a high likelihood is selected and dynamic programming is executed so that the pitch of the speech signal can be accurately estimated. The pitch estimating method comprises computing a normalized autocorrelation function of a windowed signal obtained by multiplying a frame of a speech signal by a window signal and determining candidate pitches from a peak value of the normalized autocorrelation function of the windowed signal, interpolating a period of the determined candidate pitches and a period estimating value representing a length of the period, generating Gaussian distributions for the candidate pitches for each frame for which the interpolated period estimating value is greater than a first threshold value, mixing the Gaussian distributions which are located at a distance less than a second threshold value to generate mixture Gaussian distributions and selecting at least one of the mixture Gaussian distributions that a likelihood exceeding a third threshold value, and executing dynamic programming for the frames to estimate the pitch of each frame, based on the candidate pitches of each of the frames and the selected mixture Gaussian distributions.

33 Claims, 14 Drawing Sheets

OTHER PUBLICATIONS

Sonmez et al. "A Lognormal Tied Mixture Model of Pitch for Prosody Based Speaker Recognition", EuroSpeech, 1997.*

Sun "Pitch determination and voice quality analysis using subharmonic-to-harmonic ratio", IEEE, Proceedings of ICASSP, 2002.*

Shahrokni, "Non parametric measure", [online], pubished on [Jun. 21, 2008], retrieved on [Jun. 16, 2008], retrieved from: http://homepages.inf.ed.ac.uk/rbf/CVonline/LOCAL_COPIES/SHAHROKNI1/node8.html.*

Droppo et al. "Maximum a posteriori pitch tracking", Fifth International Conference on Spoken Language Processing, 1998.*

Gerhard "Pitch extraction and fundmental frequency: history and current techniques", Tech Report, University of Regina, Canada, 2003.*

Ueda et al. "Split and merge EM algorithm for improving Gaussian mixture density estimates". Journal of VLSI Signal Processing, 2000.*

* cited by examiner

FIG. 15

| METHOD | MALE | | | FEMALE | | | AVERAGE ERROR RATIO (%) | AVERAGE HIGH/LOW RATIO (%) |
|---|---|---|---|---|---|---|---|---|
| | PITCH FRAME | HIGH/LOW FRAME | V2U FRAME | PITCH FRAME | HIGH/LOW FRAME | V2U FRAME | | |
| G.723 | 4095 | 59/35 | 215 | 6316 | 69/56 | 64 | 2.1 | 1.2/0.87 |
| YIN | 4095 | 16/26 | 0 | 6316 | 67/31 | 0 | 1.3 | 0.8/0.55 |
| CC | 4095 | 70/64 | 311 | 6316 | 44/58 | 240 | 2.27 | 1.1/1.18 |
| CC+TK1 | 4095 | 31/46 | 245 | 6316 | 43/113 | 199 | 2.24 | 0.7/1.53 |
| AC | 4095 | 28/41 | 213 | 6316 | 44/49 | 251 | 1.6 | 0.7/0.86 |
| AC+TK1 | 4095 | 25/86 | 149 | 6316 | 39/65 | 205 | 2.1 | 0.6/1.45 |
| INVENTION | 4095 | 0/20 | 59 | 6316 | 22/35 | 15 | 0.74 | 0.2/0.53 |

METHOD AND APPARATUS FOR ESTIMATING PITCH OF SIGNAL

CROSS-REFERENCE TO RELATED APPLICATIONS

This application claims the benefit of Korean Patent Application No. 10-2004-0081343, filed on Oct. 12, 2004, in the Korean Intellectual Property Office, the disclosure of which is incorporated herein by reference.

BACKGROUND OF THE INVENTION

1. Field of the Invention

The present invention relates to a method and apparatus for estimating the fundamental frequency, that is, the pitch, of a speech signal, and more particularly to a method and an apparatus by which mixture Gaussian distributions are generated based on candidate pitches having high period estimating values, a mixture Gaussian distribution having a high likelihood is selected and dynamic programming is executed so that the pitch of the speech signal can be accurately estimated.

2. Description of Related Art

Recently, various applications for recognizing, synthesizing and compressing a speech signal have been developed. In order to accurately recognize, synthesize and compress a speech signal, it is very important to estimate the fundamental frequency, that is, the pitch, of the speech signal, and, accordingly, many studies on a method for accurately estimating the pitch have been conducted. General methods for extracting the pitch include a method for extracting the pitch from a time domain, a method for extracting the pitch from a frequency domain, a method for extracting the pitch from an autocorrelation function domain and a method for extracting the pitch from the property of a waveform.

U.S. Pat. No. 6,012,023 discloses a method for extracting voiced sound and voiceless sound of a speech signal to accurately detect the pitch of the speech signal which has an autocorrelation value with a halving or doubling pitch that is higher than the pitch to be extracted.

U.S. Pat. No. 6,035,271 discloses a method for selecting candidate pitches from a normalized autocorrelation function, determining the points of anchor pitches based on the selected candidate pitches, and forwardly and backwardly performing a search from the points of the anchor pitches to extract the pitch.

However, these conventional pitch extracting methods are affected by a Formant frequency, and thus, the pitch cannot be accurately estimated.

BRIEF SUMMARY

An aspect of the present invention provides a method for accurately estimating the pitch of a speech signal.

Another aspect of the present invention also provides an apparatus for accurately estimating the pitch of a speech signal.

According to an aspect of the present invention, there is provided a pitch estimating method including computing a normalized autocorrelation function of a windowed signal obtained by multiplying a frame of a speech signal by a window signal and determining candidate pitches from a peak value of the normalized autocorrelation function of the windowed signal, interpolating a period of the determined candidate pitches and a period estimating value representing a length of the period, generating Gaussian distributions for the candidate pitches for each frame for which the interpolated period estimating value is greater than a first threshold value, mixing the Gaussian distributions which are located at a distance less than a second threshold value to generate mixture Gaussian distributions and selecting at least one of the mixture Gaussian distributions that has a likelihood exceeding a third threshold value, and executing dynamic programming for the frames to estimate the pitch of each frame based on the candidate pitches of each of the frames and the selected mixture Gaussian distributions.

The method may further include determining whether the candidate pitch exists in a sub-harmonic frequency range of the average frequency generated based on the average frequency and the variance of the selected mixture Gaussian distributions and reproducing an additional candidate pitch from the candidate pitches in the sub-harmonic frequency range having the largest period estimating value.

The method may further include repeating the mixing the Gaussian distributions and selecting at least one of the mixture Gaussian distributions, the executing dynamic programming and the determining whether the candidate pitch exists in the sub-harmonic frequency range and reproducing the additional candidate pitch until the sum of the local distances up the final frame is not increased during the dynamic programming and no additional candidate pitches are generated.

According to another aspect of the present invention, there is provided a pitch estimating apparatus including a first candidate pitch determining unit computing a normalized autocorrelation function of a windowed signal obtained by multiplying a frame of a speech signal by a window signal and determining candidate pitches from a peak value of the normalized autocorrelation function of the windowed signal, an interpolating unit interpolating a period of the determined candidate pitches and a period estimating value representing a length of the period, a Gaussian distribution generating unit generating Gaussian distributions for the candidate pitches for each frame for which the interpolated period estimating value is greater than a first threshold value, a mixture Gaussian distribution generating unit mixing the Gaussian distributions that have a distance smaller than a second threshold value to generate mixture Gaussian distributions, a mixture Gaussian distribution selecting unit selecting at least one of the mixture Gaussian distributions that has a likelihood exceeding a third threshold value, and a dynamic programming executing unit executing dynamic programming for the frames based on the candidate pitches of each frame and the selected mixture Gaussian distributions to estimate the pitch of each frame.

The apparatus may further include an additional candidate pitch reproducing unit determining whether the candidate pitch exists in a sub-harmonic frequency range of the average frequency generated based on the average frequency and the variance of the selected mixture Gaussian distributions and reproducing an additional candidate pitch from the candidate pitches in the sub-harmonic frequency range having the largest period estimating value.

The apparatus may further include a tracking determining unit continuously repeating the pitch tracking of the speech signal based on the output values of the dynamic programming executing unit and the additional candidate pitch reproducing unit.

According to another aspect of the present invention, there is provided computer-readable storage media encoded with processing instructions for causing a processor to perform the aforementioned method.

Additional and/or other aspects and advantages of the present invention will be set forth in part in the description which follows and, in part, will be obvious from the description, or may be learned by practice of the invention.

BRIEF DESCRIPTION OF THE DRAWINGS

Additional and/or other aspects and advantages of the present invention will be set forth in part in the description which follows and, in part, will be obvious from the description, or may be learned by practice of the invention:

FIG. 15 is a table comparing the capabilities of the pitch estimating method according to an embodiment of the present invention and a conventional method.

DETAILED DESCRIPTION OF EMBODIMENTS

Figure 1:
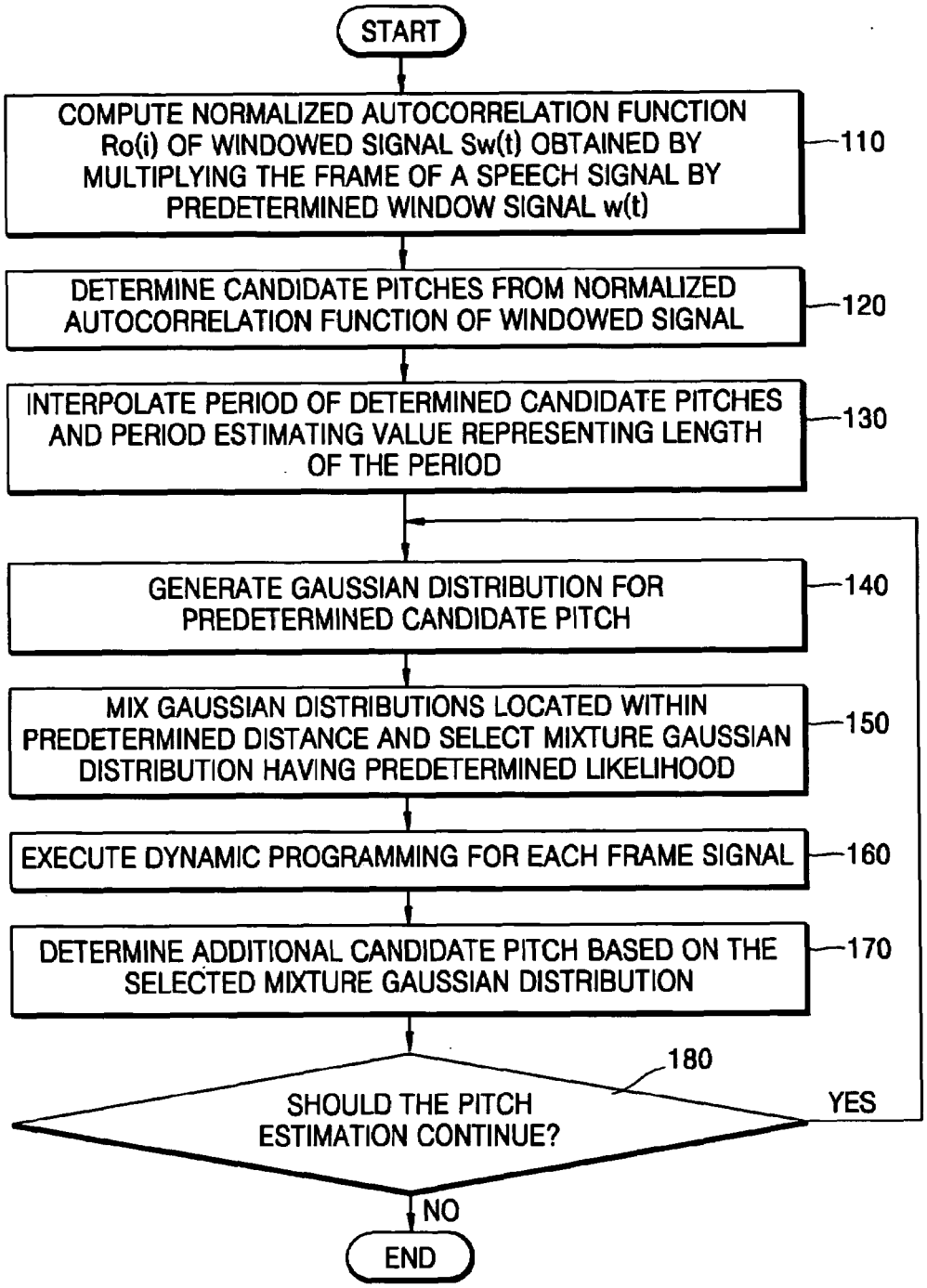
FIG. 1 is a flowchart illustrating a method of estimating the pitch of a speech signal according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a flowchart illustrating a method of estimating the pitch of a speech signal according to an embodiment of the present invention.

Referring to FIG. 1, the normalized autocorrelation function (Ro(i)) of a windowed signal (Sw(t)) obtained by multiplying the frame of a speech signal by a predetermined window signal (w(t)) is computed (operation 110). The pitch of the speech signal is a speech property which is difficult to estimate and an autocorrelation function is generally used to estimate the pitch of the speech signal. However, the pitch, of the speech signal is obscured by a Formant frequency. If a first Formant frequency is very strong, a period appears in the wavelength of the speech signal and is applied to the autocorrelation function. Also, since the speech signal is a quasi-periodic function, not a rarely periodic function, the confidence of the autocorrelation function is significantly deteriorated. Accordingly, the present embodiment provides a pitch estimating method which is more advanced than a pitch estimating method using a conventional autocorrelation function.

Figure 2:
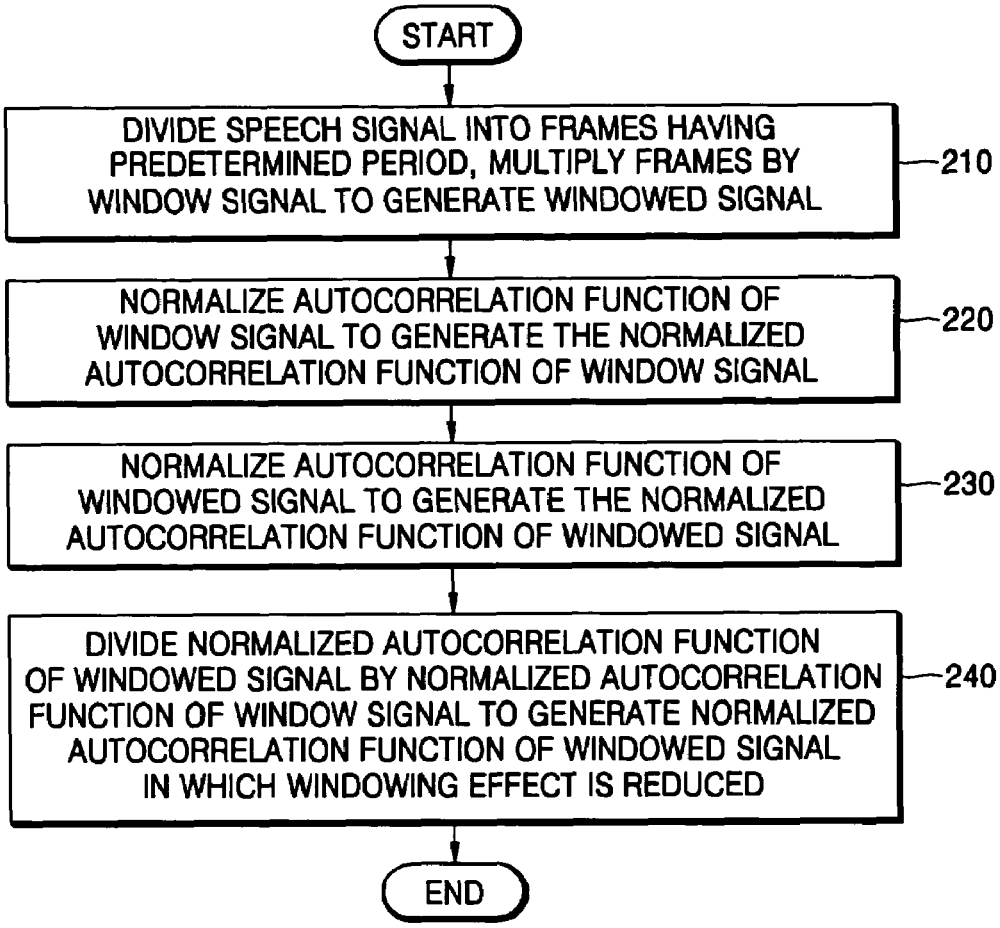
FIG. 2 is a flowchart illustrating in detail an operation of computing a normalized autocorrelation function of a windowed signal indicated in FIG. 1.
Figure 3:
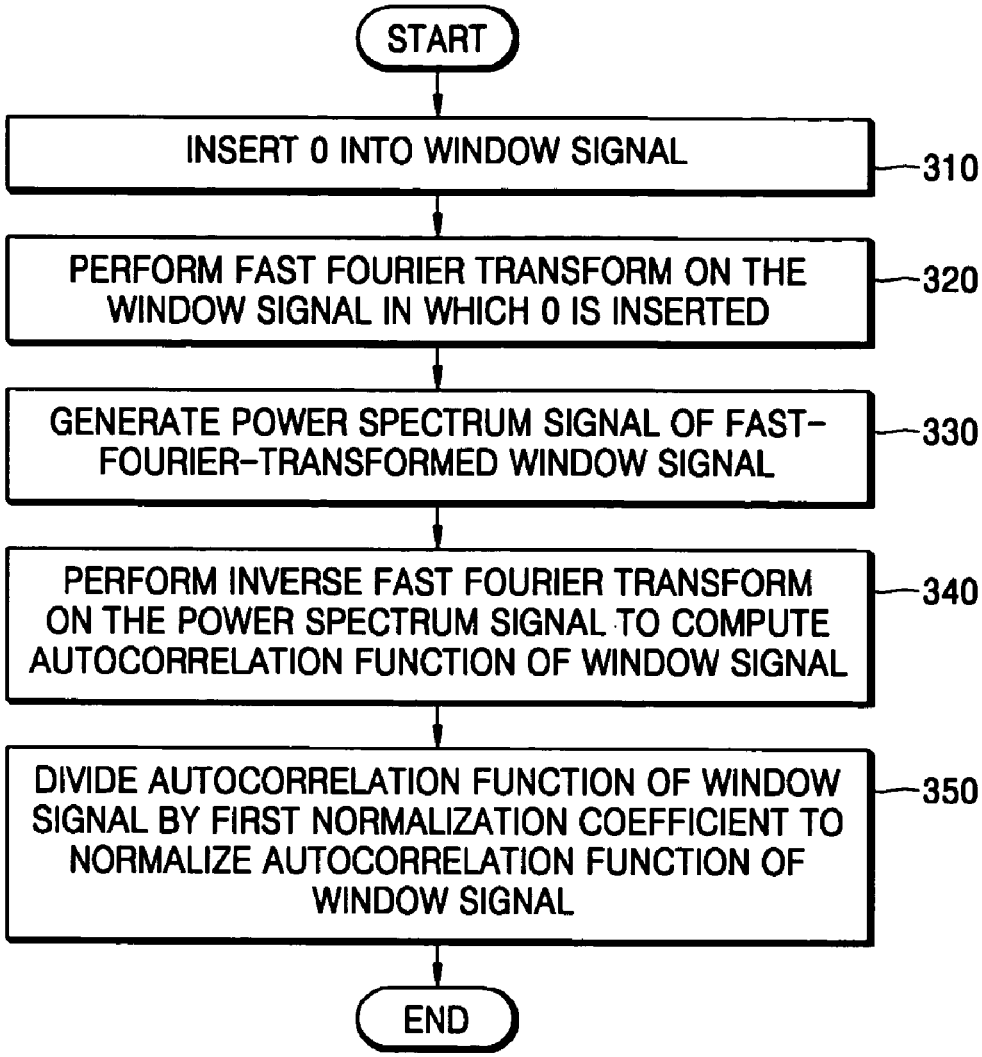
FIG. 3 is a flowchart illustrating in detail an operation of computing a normalized autocorrelation function of a window signal indicated in FIG. 2.
Figure 4:
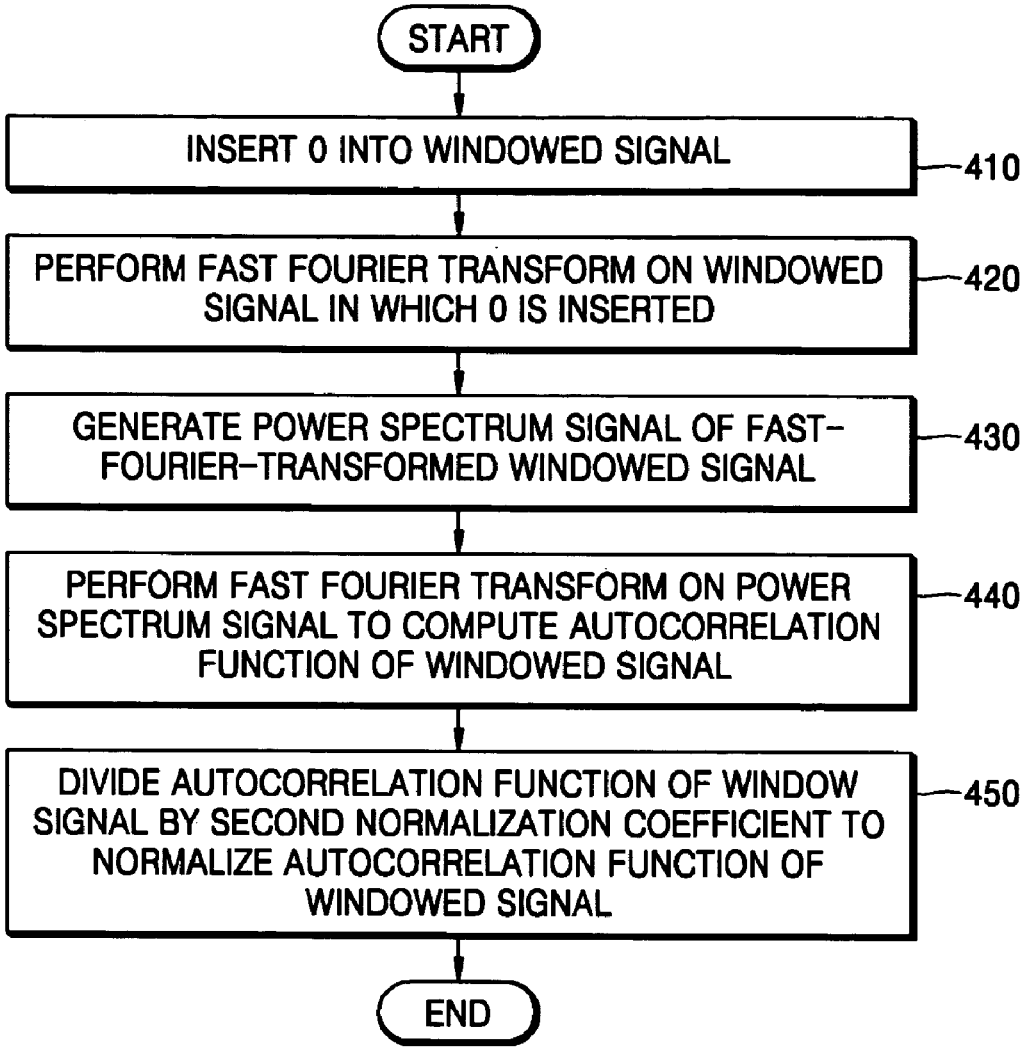
FIG. 4 is a flowchart illustrating in detail an operation of computing a normalized autocorrelation function of the windowed signal indicated in FIG. 2.

FIGS. 2 through 4 are flowcharts illustrating in detail the operation of computing a normalized autocorrelation function of the windowed signal according to an embodiment of the present invention. Referring to FIG. 2, the speech signal is divided into frames having a period T, which is referred to as a window length or frame width, and then the frames are multiplied by a predetermined window signal, thereby generating a windowed signal (operation 210). The window signal is a symmetric function such as a sine squared function, a hanning function or a hamming function. Preferably, the speech signal is converted to the windowed signal using the hamming function.

The autocorrelation function (Rw(τ)) of the window signal is normalized to generate the normalized autocorrelation function of the window signal (operation 220). Preferably, the hamming function is used as the window signal and the normalized autocorrelation function of the hamming function is computed using equation (1).

$$Rw(\tau) = \frac{\left(1 - \frac{|\tau|}{T}\right)\left(0.2916 + 0.1058\cos\frac{2\pi t}{T}\right) + 0.3910\frac{1}{2\pi}\sin\frac{2\pi|\tau|}{T}}{0.3974} \tag{1}$$

In addition, the autocorrelation function of the windowed signal generated in operation 210 is normalized to generate the normalized autocorrelation function of the windowed signal (operation 230). The normalized autocorrelation function (Rs(τ)) of the windowed signal, where the windowing effect is not reduced, is a symmetric function and is given by equation (2).

$$Rs(\tau) = Rs(-\tau) = \frac{\int_0^{T-c} Sw(t)Sw(t+\tau)\,dt}{\int_0^T Sw^2(t)\,dt} \tag{2}$$

The normalized autocorrelation function of the windowed signal is divided by the normalized autocorrelation function of the window signal to generate a normalized autocorrelation function (Ro(τ)) of the windowed signal in which the windowing effect is reduced (as shown in Equation (3) (operation 240)).

$$Ro(\tau) \approx \frac{Rs(\tau)}{Rw(\tau)} \tag{3}$$

FIG. 3 is a flowchart illustrating in detail the operation of computing the normalized autocorrelation function of the windowed signal indicated in FIG. 2. Referring to FIG. 3, to increase a pitch resolution, zero is inserted into the window signal (operation 310) and a Fast Fourier Transform (FFT) is performed on the window signal in which the zero is inserted (operation 320). The power spectrum signal of the transformed signal is generated (operation 330) and an Inverse Fast Fourier Transform is performed on the power spectrum signal to compute the autocorrelation function of the window signal (operation 340).

Generally, an autocorrelation function is generated by multiplying an original signal with the signal obtained by delaying the original signal by a predetermined amount. However, in the present embodiment, the autocorrelation function is computed using equation (4).

Power spectrum signal=FFT (window signal in which the zero is inserted), Autocorrelation function=IFFT (power spectrum signal) (4)

Accordingly, the autocorrelation function can be computed by the Inverse Fast Fourier Transforming (IFFF) the power spectrum signal. Since a Fast Fourier Transform and an Inverse Fast Fourier Transform are different from each other only by a scaling factor and only the peak value of the autocorrelation function is required in the present invention, the Fast Fourier Transform can be used instead of the Inverse Fast Fourier Transform. The autocorrelation function of the window signal is divided by a first normalization coefficient to generate the normalized autocorrelation function of the window signal (operation 350).

FIG. 4 is a flowchart illustrating in detail the operation of computing the normalized autocorrelation function of the windowed signal indicated in FIG. 2. Referring to FIG. 4, zero is inserted into the windowed signal (operation 410) and a Fast Fourier Transform (FFT) is performed on the windowed signal in which the zero is inserted (operation 420). The power spectrum signal of the transformed windowed signal is generated (operation 430) and a Fast Fourier Transform is performed on the power spectrum signal to compute the autocorrelation function of the windowed signal (operation 440). The autocorrelation function of the windowed signal is divided by a second normalization coefficient to generate the normalized autocorrelation function of the windowed signal (operation 450). Operations 310 through 340 of FIG. 3 and operations 410 to 440 perform the same function on the window signal and the windowed signal, respectively. However, in operation 350 of FIG. 3 and operation 450 of FIG. 4, the normalization coefficients by which the autocorrelation function of the window signal and the autocorrelation function of the windowed signal are divided to perform the normalization are different from each other.

Referring back to FIG. 1, the candidate pitches are determined from the normalized autocorrelation function of the windowed signal (operation 120). The candidate pitches for the speech signal are determined from the peak value of the normalized autocorrelation function of the windowed signal exceeding a predetermined fourth threshold value TH4.

The period of the determined candidate pitches and the period estimating value (pr) representing the length of the period are interpolated (operation 130). The pitch is derived from the candidate pitch period, which is estimated from the peak value of the normalized autocorrelation function of the windowed signal. The candidate pitch is determined by dividing the sampling frequency by the delay, which is an integer, of the normalized autocorrelation function of the windowed signal. However, the actual period of the candidate pitch may not be an integer, and, accordingly, the period of the candidate pitch and the period estimating value of the period must be interpolated in order to more accurately obtain the period of the candidate pitch and period estimating value of the period.

Based on the period estimating value of the interpolated period, the candidate pitches having an interpolated period estimating value greater than a first threshold value TH1 are selected (hereinafter, candidate pitches having an interpolated period estimating value greater than the first threshold value TH1 are referred to as anchor pitches) and Gaussian distributions of the anchor pitches are generated (operation 140). Among the generated Gaussian distributions, the Gaussian distributions which are located within a distance smaller than a second threshold value TH2 are mixed to generate mixture Gaussian distributions and at least one mixture Gaussian distribution having a likelihood exceeding a third threshold value TH3 is selected from the generated mixture Gaussian distributions (operation 150).

In detail, the generated Gaussian distributions are used to generate one mixture Gaussian distribution through a circular mixing process. That is, if the distance between two Gaussian distributions is smaller than the second threshold value TH2, the two Gaussian distributions are mixed with each other. In order to measure the distance between the two Gaussian distributions, various measuring methods may be used. For example, a divergence distance measuring method expressed by Jd(x)=tr(Sw+Sb) may be used. Here, Sw is a within-divergence matrix and Sb is a between-divergence matrix. Also, a JB method for measuring the Bhattacharya distance between two Gaussian distributions and a JC method for measuring the Chernoff distance between two Gaussian distributions may be used.

The distance between two Gaussian distributions is computed using equation (5).

$$JD = \int_x [p(x \mid \omega_i) - p(x \mid \omega_j)] \ln \frac{p(x \mid \omega_i)}{p(x \mid \omega_j)} dx \tag{5}$$

Here, if the classes of $\omega_i$ and $\omega_j$ are the Gaussian distribution, equation (5) can be expressed as equation (6).

$$JD = \frac{1}{2} tr\left[\sum_i^{-1}\sum_j + \sum_j^{-1}\sum_i - 2I\right] + \frac{1}{2}(u_i - u_j)^T\left(\sum_i^{-1} + \sum_j^{-1}\right)(u_i - u_j) \tag{6}$$

Here, $u_i$ and $u_j$ are the averages of the Gaussian distributions $\omega_i$ and $\omega_j$, respectively, and $\Sigma_i$ and $\Sigma_j$ are the covariance matrices of the Gaussian distributions $\omega_i$ and $\omega_j$, respectively. Also, tr indicates the trace of a matrix.

The Gaussian distributions separated having the distance shorter than the second threshold value TH2 are mixed with each other to generate the mixture Gaussian distributions which have new averages and variances. Based on the third threshold value TH3, which is determined by the histogram of the statistics of the generated Gaussian distributions, at least one of the mixture Gaussian distributions having a likelihood exceeding the third threshold value TH3 is selected.

The likelihood refers to the likelihood of the amount of data included in the Gaussian distribution and the value of the likelihood is expressed by equation (7).

$$\frac{\sum_{i=1\sim N} \log p(x_i \mid \phi)}{N} \tag{7}$$

Here, $\phi$ represents the Gaussian parameter of the Gaussian distribution, x represents a data sample, and N represents the number of the data samples.

The candidate pitches determined in one frame are modeled to one Gaussian distribution and all of the candidate pitches of the speech signal generate the mixture Gaussian distribution. In the present embodiment, the candidate pitches used to generate the Gaussian distribution are the anchor pitches which have a period estimating value greater than the first threshold value. Since the mixture Gaussian distribution is generated from the Gaussian distributions generated using the anchor pitches, the pitch of the speech signal can be more accurately estimated.

Based on the candidate pitches determined from the peak value of the normalized autocorrelation function of the windowed signal and the selected mixture Gaussian distributions, the dynamic programming is performed using the candidate pitches for each of the frames of the speech signal (operation 160). When performing the dynamic programming using the candidate pitches for each of the frames, the distance value for the candidate pitches of each frame is stored so that the candidate pitch having the largest value is tracked as the pitch for the final frame. Operation of executing the dynamic programming on each frame of the speech signal will be described with reference to FIG. 7 in detail later.

Whether the candidate pitch exists in the sub-harmonic frequency range of the average frequency generated using the average frequency and the variance of the selected mixture Gaussian distributions is determined to generate an additional candidate pitch from the candidate pitches in the sub-harmonic frequency range having the largest period estimating values (operation 170). Candidate pitches which are not estimated and are missed in the frame generally have low period estimating values, but may be accurate pitches in some cases. Also, although the candidate pitches estimated in the previous operation have high period estimating values, they may be doubling or halving values of the pitches. In operation 170, the pitches which are not estimated and are missed in operations 110 to 160 are estimated. Operation 170 will be described with reference to FIG. 8 in detail later.

Operations 140 through 170 are repeated until two conditions are met: the sum of the local distances of the frames is no longer increased in operation 160 (condition 1); and additional candidate pitches are no longer generated in operation 170 (condition 2), with the two conditions being evaluated in operation 180. That is, the operations generating the updated Gaussian distributions using the candidate pitches of each frame including the generated additional candidate pitch, generating the mixture Gaussian distributions by mixing the Gaussian distributions which are located within a distance smaller than the second threshold value and selecting the mixture Gaussian distribution having a likelihood greater than the third threshold value are repeated. Based on the selected mixture Gaussian distribution and the candidate pitches including the additional candidate pitches, the dynamic programming is executed again. If condition 1 and condition 2 are satisfied when performing operations 140 through 170, the final pitch is estimated.

During practice of the present embodiment, it was noted that condition 1 and condition 2 were satisfied by repeating operations 140 through 170 two to three times, except when candidate pitches having low period estimating values were scattered and when husky speech was analyzed. However, in order to preferably avoid repeating operations 140 through 170 indefinitely, the number of repetitions may be set to a certain value.

Figure 5:
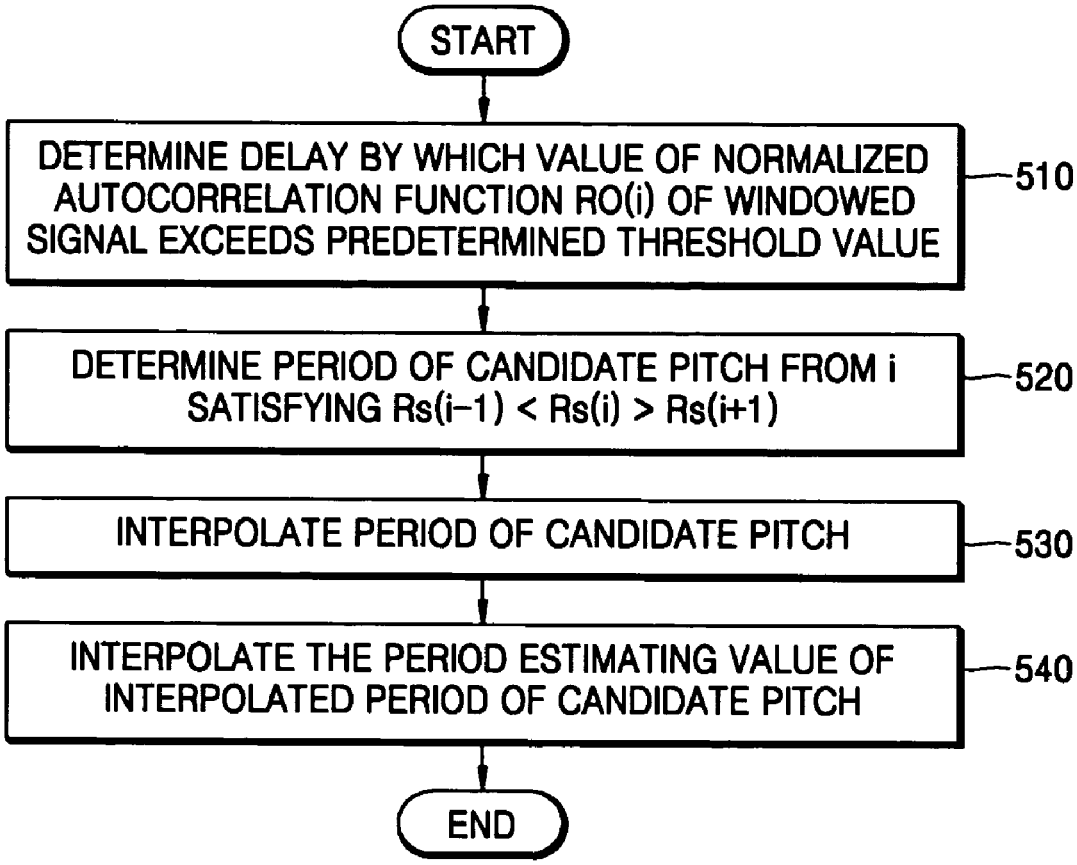
FIG. 5 is a flowchart illustrating in detail an operation of determining candidate pitches from the peak value of the normalized autocorrelation function of the windowed signal and an operation of computing the period and a period estimating value of the determined candidate pitches indicated in FIG. 1.

FIG. 5 is a flowchart illustrating in detail the operation (operation 120) of determining the candidate pitches from the peak value of the normalized autocorrelation function of the windowed signal and operation (operation 130) of computing the period and the period estimating value of the determined candidate pitches indicated in FIG. 1.

The delay ($\tau$) by which the value of the normalized autocorrelation function of the windowed signal exceeds the fourth threshold value TH4 are determined (operation 510) and the delay satisfying formula (8) among the determined lag values is determined to be the period of the candidate pitch (operation 520).

$$Rs(\tau-1)<Rs(\tau)>Rs(\tau+1) \tag{8}$$

The candidate pitch is interpolated using equation (10) (operation 530). Thus, the determined delay, that is, the period of the candidate pitch, is estimated from the interpolated value (x).

$$x=\tau+\frac{Rs(\tau+1)-Rs(\tau-1)}{2(2Rs(\tau)-Rs(\tau-1)-Rs(\tau+1))} \tag{9}$$

After the interpolated value of the candidate pitch period is computed from equation (9), the period estimating value (pr) of the interpolated value is computed using equation (10) (operation 540). Here, the period estimating value (pr) means the pitch candidate's periodic evaluation value estimation, i.e., the estimated candidate pitch value within the interpolated candidate pitch period.

$$pr=\sum_{ix=i}^{I}\left\{Rs(ix)\times\frac{\sin[\pi(x-ix)]}{2\pi(x-ix)}\times\left[1+\cos\frac{\pi(x-ix)}{x-I+1}\right]\right\}+\sum_{ix=j}^{I}\left\{Rs(ix)\times\frac{\sin[\pi(ix-x)]}{2\pi(ix-x)}\times\left[1+\cos\frac{\pi(ix-x)}{J-x+1}\right]\right\} \tag{10}$$

Figure 6:
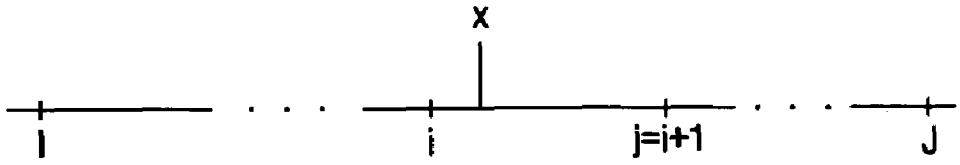
FIG. 6 illustrates a coordinate used for interpolating the period of the determined candidate pitch.

Referring to FIG. 6, x is a value between two integers i and j, i is the largest integer smaller than x, and j is the smallest integer among the integers greater than x. On the other hand, ix is a variable of the integer in the range [I, J]. For example, in case that I=i−4 and J=i+4, the 10 values Rs(i) adjacent to x are used to compute the period estimating value.

On the other hand, the period estimating value is interpolated using sin(x)/x as expressed in equation (10). By using sin(x)/x (referred to as the sinc function), the accuracy of the pitch estimating value is increased by 20%.

Figure 7:
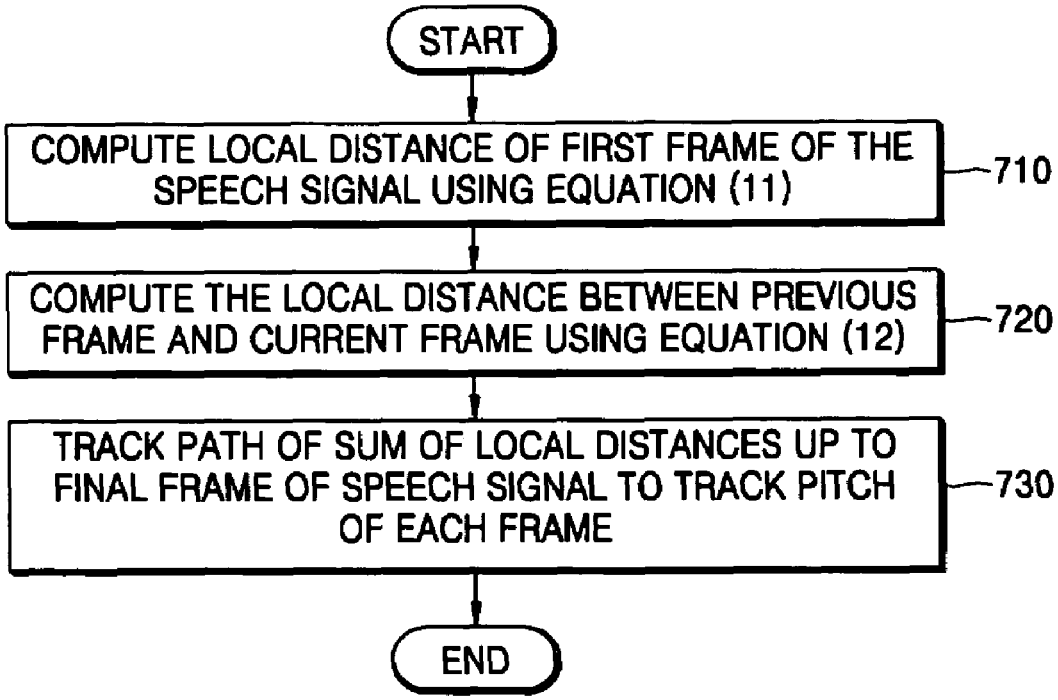
FIG. 7 is a flowchart illustrating in detail an operation of executing dynamic programming for each frame based on a selected mixture Gaussian distribution indicated in FIG. 1.

FIG. 7 is a flowchart illustrating in detail the operation of executing dynamic programming for each frame based on the selected mixture Gaussian distribution indicated in FIG. 1.

The local distance (Dis(f)) of a first frame is computed using equation (11) (operation 710). The first frame has a plurality of the candidate pitches and the local distance between the candidate pitches is computed.

$$Dis1(f)=\frac{pr^2}{\sigma_{pr}^2}-\frac{(f-u_{seg})^2}{\sigma_{seg}^2}-\min_{mix}\left\{\frac{(f-u_{mix})^2}{\sigma_{mix}^2}\right\} \tag{11}$$

Here, f is a candidate pitch, pr is the period estimating value of a candidate pitch, and $\sigma_{pr}$ is the variance of the period estimating value computed from every candidate pitch. The value of $\sigma_{pr}$ may be set to 1. $u_{seg}$ and $\sigma_{seg}$ are the average and the variance of the candidate pitch computed from each frame, respectively, and $u_{mix}$ and $\sigma_{mix}$ are the average and the variance of the mixture Gaussian distribution, respectively. Here, $$\frac{(f-u_{seg})^2}{\sigma_{seg}^2}$$

is an estimate of the Gaussian distance between the central frequency of each frame and the candidate pitch. On the other hand, $$\min_{mix}\left\{\frac{(f-u_{mix})^2}{\sigma_{mix}^2}\right\}$$

is an estimate of the Gaussian distance between the closest mixture Gaussian distribution and the candidate pitch. The greater the value of Dis(f), the higher the probability that the candidate pitches are included in the final pitch.

The local distance (Dis2(f, $f_{pre}$)) between a previous frame and a current frame is computed using equation (12) (operation 720).

$$Dis2(f, f_{pre}) = \frac{pr^2}{\sigma_{pr}^2} - \frac{(f-u_{seg})^2}{\sigma_{seg}^2} - \frac{(f-f_{pre}-u_{df,seg})^2}{\sigma_{df,seg}^2} - \min_{mix}\left\{\frac{(f-u_{mix})^2}{\sigma_{mix}^2} + \frac{(f-f_{pre}-u_{df,mix})^2}{\sigma_{df,mix}^2}\right\} \quad (12)$$

$$Dis2(f, f_{pre}) = \frac{pr^2}{\sigma_{pr}^2} - \frac{(f-u_{seg})^2}{\sigma_{seg}^2} - \frac{(f-f_{pre}-u_{df,seg})^2}{\sigma_{df,seg}^2} - \min_{mix}\left\{\frac{(f-u_{mix})^2}{\sigma_{mix}^2} + \frac{(f-f_{pre}-u_{df,mix})^2}{\sigma_{df,mix}^2}\right\}$$

Here, $f_{pre}$ is the candidate pitch in the previous frame and the other items between Dis1(f) and Dis2(f, $f_{pre}$) are $$\frac{(f-f_{pre}-u_{df,seg})^2}{\sigma_{df,seg}^2} \text{ and } \frac{(f-f_{pre}-u_{df,mix})^2}{\sigma_{df,mix}^2}.$$

$$\frac{(f-f_{pre}-u_{df,seg})^2}{\sigma_{df,seg}^2} \text{ and } \frac{(f-f_{pre}-u_{df,mix})^2}{\sigma_{df,mix}^2}$$

represent the value of $f-f_{pre}$ that is, the Gaussian distance of delta frequency. Accordingly, $u_{df,seg}$ and $\sigma_{df,seg}$ represent the average and the variance of the delta frequency computed from each frame, respectively, and $u_{df,mix}$ and $\sigma_{df,mix}$ represent the average and the variance of the delta frequency computed from the mixture Gaussian distribution.

For example, the local distance for the i-th candidate pitch of the first frame is computed as $$\text{Measure}(1, i) = Dis1(f_{1,i}) = \frac{pr_{1,i}^2}{\sigma_{pr}^2} - \frac{(f_{1,i}-u_{seg})^2}{\sigma_{seg}^2} - \min_{mix}\left\{\frac{(f_{1,i}-u_{mix})^2}{\sigma_{mix}^2}\right\}$$

using equation (12), and the local distance from the i-th candidate pitch of the (n−1)-th frame to the j-th candidate pitch of the n-th frame is given by Measure(n,j)=Max i{Measure(n−1,i)+Dis2(n,j)}. Measure (n, j) is measured up to the final frame N. In the final frame, the largest Measure(N, j) is selected and the j-th candidate pitch is selected to the tracked pitch of the final frame.

Figure 8:
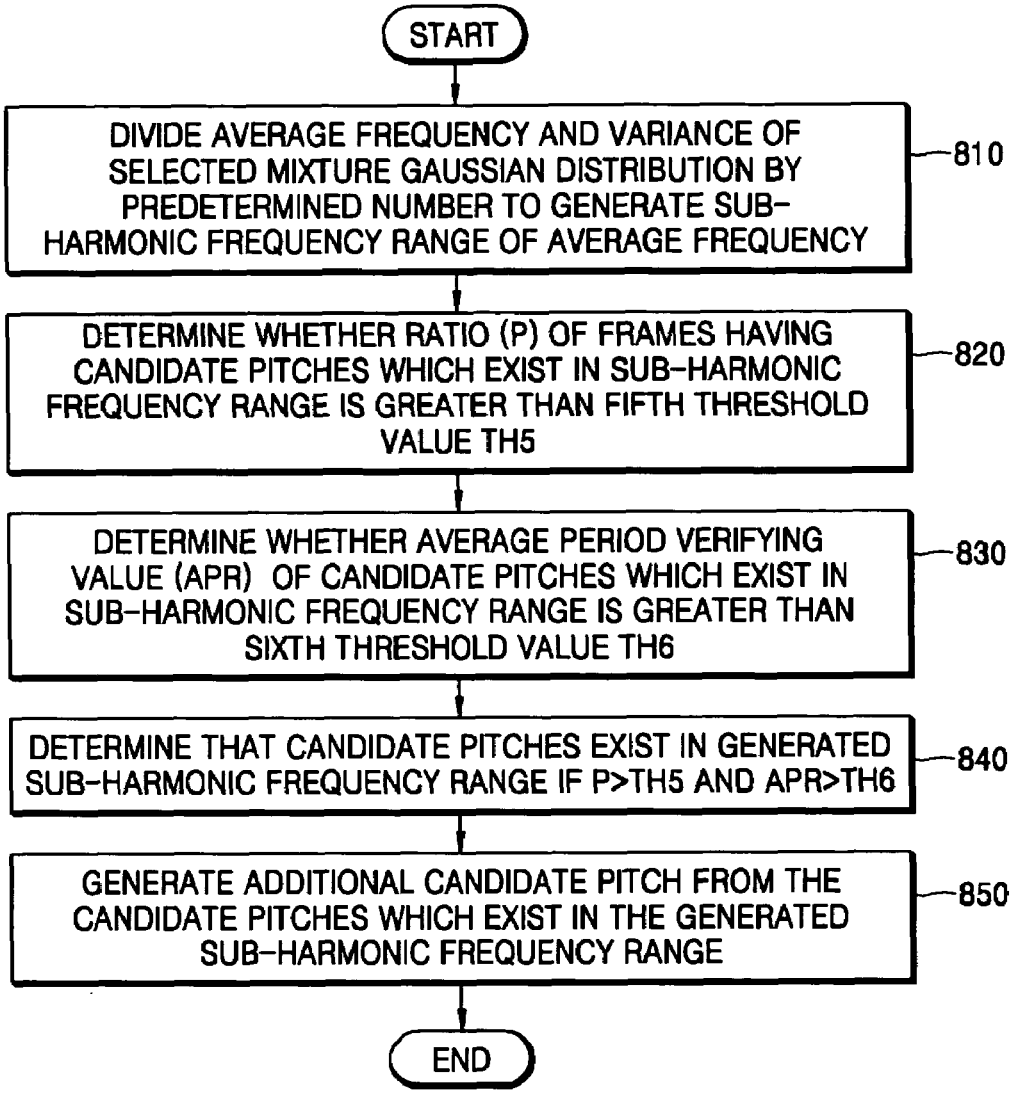
FIG. 8 is a flowchart illustrating in detail an operation of reproducing an additional candidate pitch indicated in FIG. 1.

FIG. 8 is a flowchart illustrating in detail the operation (operation 170) of reproducing the additional candidate pitch indicated in FIG. 1.

Referring to FIG. 8, the average frequency and the variance of the selected mixture Gaussian distribution are divided by a predetermined number as indicated in equation (13) to generate a set of sub-harmonic frequency range of the average frequency in which a missed additional candidate pitch may exist (operation 810).

$$f_{bin(i)} = \frac{u_{mix}}{i},\ b_{bin(i)} = \frac{\sigma_{mix}}{i} \quad (13)$$

Here, i is a certain number. For example, if the values of i are 1, 2, 3, and 4, the average frequency of the mixture Gaussian distribution is 900 Hz and the variance thereof is 200 Hz, in the first through fourth sub-harmonic frequency range, the central frequency and the bandwidth are 900 Hz/±100 Hz, 450 Hz/±50 Hz, 300 Hz/±33 Hz and 225 Hz/±25 Hz, respectively. If a plurality of the mixture Gaussian distributions are selected in operation 150 of FIG. 1, a set of sub-harmonic frequency ranges generated from the mixture Gaussian distributions is generated.

Next, it is determined whether the candidate pitches of each frame exist in the generated sub-harmonic frequency range (operations 820 through 840). First, it is determined whether the ratio (P) of the frames having the candidate pitches which exist in the generated sub-harmonic frequency range is greater than a predetermined fifth threshold value TH5 (operation 820), and thus whether the average period verifying value (APR) of the candidate pitches which exist in the sub-harmonic frequency range is greater than a sixth threshold value TH6 (operation 830). If P is greater than the fifth threshold value and APR is greater than the sixth threshold value, it is determined that the candidate pitches exist in the generated sub-harmonic frequency range (operation 840).

If it is determined that the candidate pitches exist in the generated sub-harmonic frequency range in operation 840, the index of the sub-harmonic frequency range, that is, the number by which the average frequency of the mixture Gaussian distribution is divided, is multiplied by the candidate pitch to generate the additional candidate pitch (operation 850). The additional candidate pitch is determined from equation (14).

$$f=\{f:f\in \text{bin}(j), \max_{fmNbins} pr(f)\}\times j \quad (14)$$

Here, f is the frequency of the candidate pitch, bin(j) is the j-th sub-harmonic frequency range of the average frequency of the mixture Gaussian distribution, and N is the number by which the average frequency of the mixture Gaussian distribution is divided. In the above-mentioned example, the average frequency 900 Hz of the mixture Gaussian distribution was divided by 4 and, accordingly, N is 4.

Figure 9:
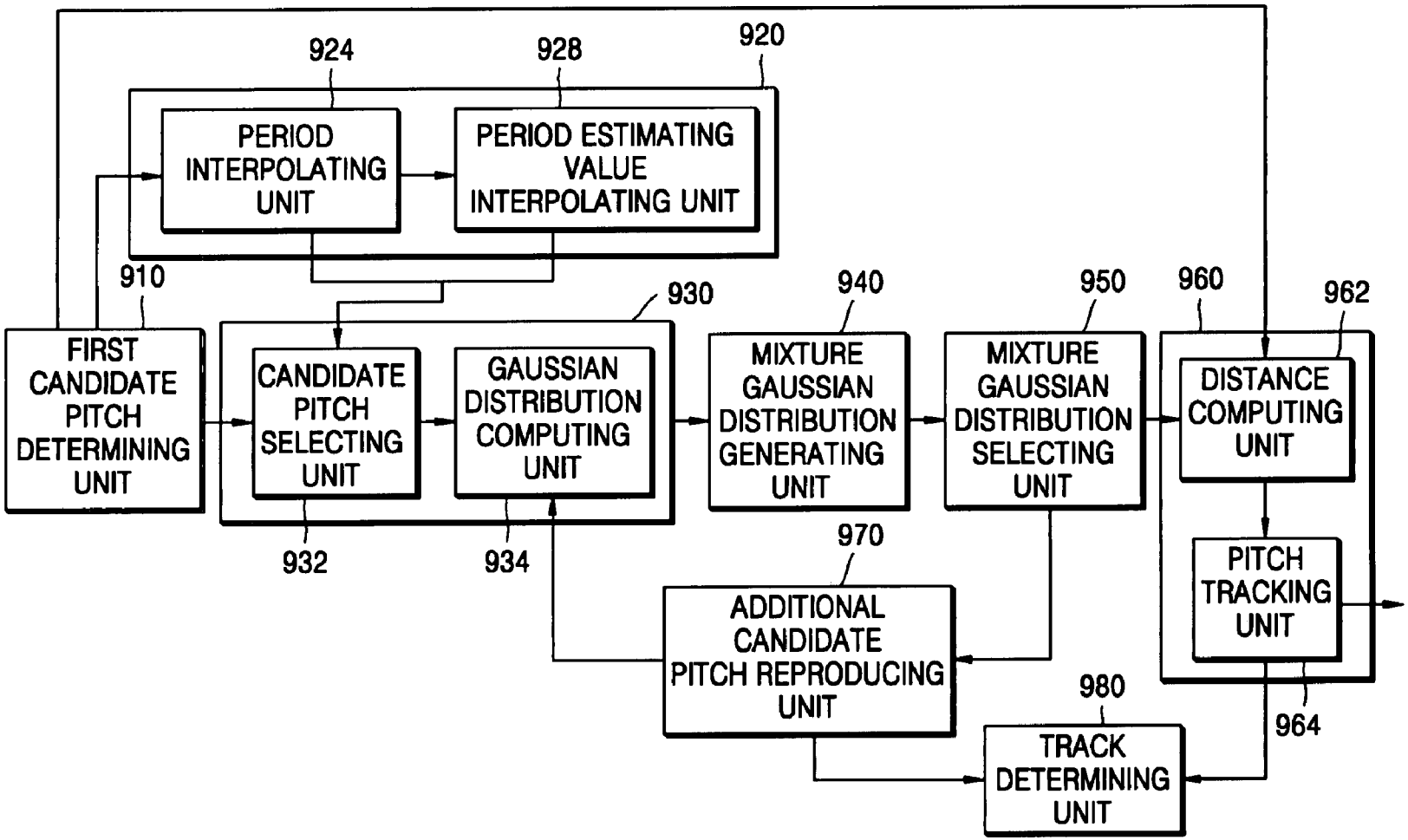
FIG. 9 is a functional block diagram of an apparatus for estimating the pitch of a speech signal according to an embodiment of the present invention.

FIG. 9 is a functional block diagram of an apparatus for estimating the pitch of a speech signal according to an embodiment of the present invention. The apparatus includes a first candidate pitch determining unit 910, an interpolating unit 920, a Gaussian distribution generating unit 930, a mixture Gaussian distribution generating unit 940, a mixture Gaussian distribution selecting unit 950, a dynamic program executing unit 960, an additional candidate pitch reproducing unit 970 and a track determining unit 980.

Figure 10:
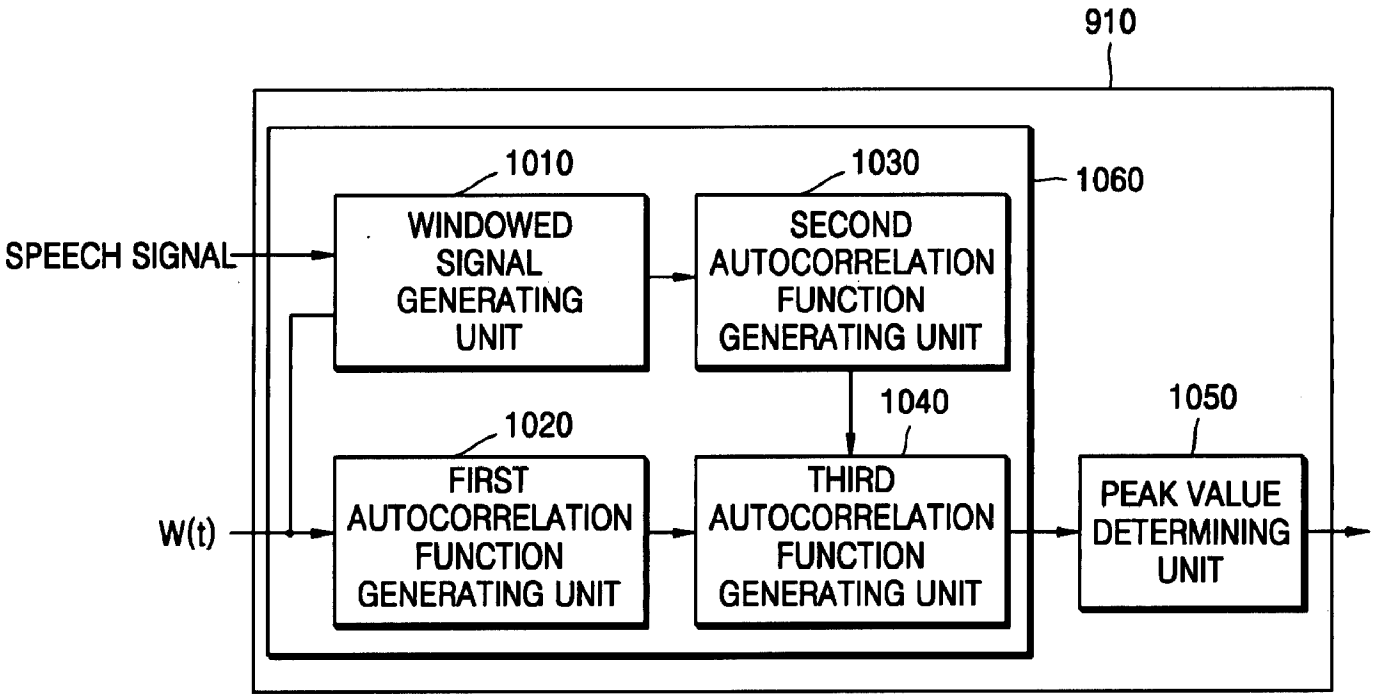
FIG. 10 is a functional block diagram of a first candidate pitch generating unit illustrated in FIG. 9.
Figure 11:
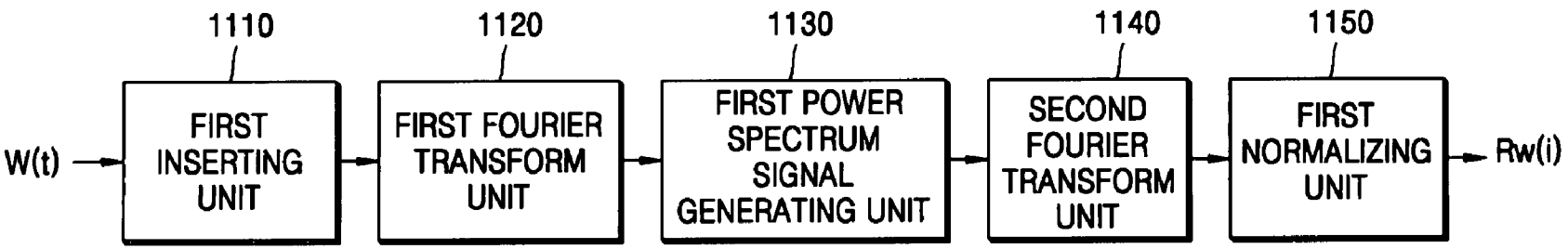
FIG. 11 is a functional block diagram of a first autocorrelation function generating unit illustrated in FIG. 10.
Figure 12:
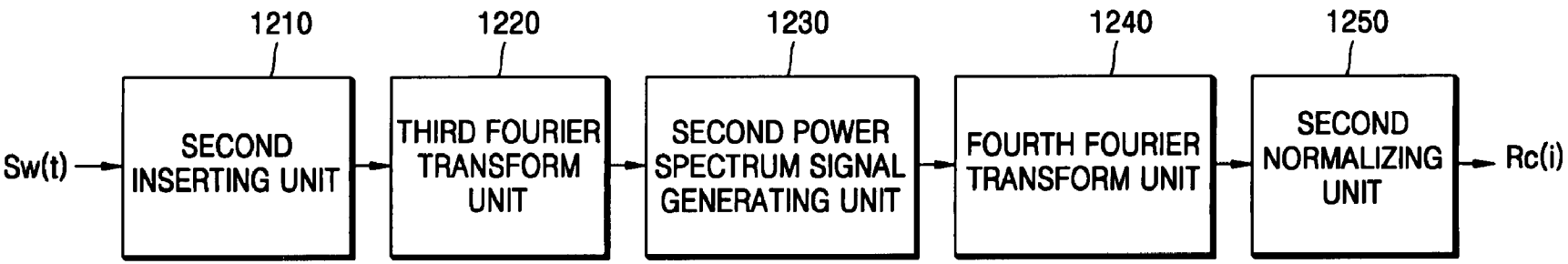
FIG. 12 is a functional block diagram of a second autocorrelation function generating unit illustrated in FIG. 10.

The first candidate pitch determining unit 910 divides a predetermined speech signal into frames and computes the autocorrelation function of the divided frame signal to determine the candidate pitches from the peak value of the autocorrelation function. Referring to FIGS. 10 through 12, the first candidate pitch determining unit 910 according to the present embodiment will now be explained in detail.

FIG. 10 is a functional block diagram of the first candidate pitch determining unit 910 illustrated in FIG. 9. Referring to FIG. 10, the first candidate pitch determining unit 910 includes an autocorrelation function generating unit 1060 and a peak value determining unit 1050. The autocorrelation function generating unit 1060 includes a windowed signal generating unit 1010, a first autocorrelation function generating unit 1020, a second autocorrelation function generating unit 1030 and a third autocorrelation function generating unit 1040.

The windowed signal generating unit 1010 receives a predetermined speech signal, divides the speech signal into frames having a predetermined period, and multiplies the divided frame signal by a window signal to generate a windowed signal. The first autocorrelation function generating unit 1020 normalizes the autocorrelation function of the window signal according to equation (1) to generate a normalized autocorrelation function of the window signal. The second autocorrelation function generating unit 1030 normalizes the autocorrelation function of the windowed signal according to equation (2) to generate a normalized autocorrelation function Rs(i) of the windowed signal and the third autocorrelation function generating unit 1040 divides the normalized autocorrelation function of the windowed signal by the normalized autocorrelation function of the window signal according to equation (3) to generate a normalized autocorrelation function of the windowed signal in which the windowing effect is reduced.

FIG. 11 is a functional block diagram of the first autocorrelation function generating unit 1020 illustrated in FIG. 10. Referring to FIG. 11, the first autocorrelation function generating unit 1020 includes a first inserting unit 1110, a first Fourier Transform unit 1120, a first power spectrum signal generating unit 1130, a second Fourier Transform unit 1140 and a first normalizing unit 1150. The first inserting unit 1110 inserts 0 into the window signal to increase the pitch resolution. The first Fourier Transform unit 1120 performs a Fast Fourier Transform on the window signal in which the zero is inserted to transform the window signal to the frequency domain. The first power spectrum signal generating unit 1130 generates the power spectrum signal of the signal transformed to the frequency domain and the second Fourier Transform unit 1140 performs a Fast Fourier Transform on the power spectrum signal to compute the autocorrelation function of the window signal. As explained in equation (4), if the Inverse Fast Fourier Transform of the power spectrum signal is performed, the autocorrelation function is obtained. The Fast Fourier Transform and the Inverse Fast Fourier Transform are different from each other by a scaling factor and only the peak value of the autocorrelation function need be judged in the present embodiment. Accordingly, in the present embodiment, the autocorrelation function of the window signal can be obtained by performing a Fast Fourier Transform two times. The autocorrelation function computed by the second Fourier Transform unit 1140 is divided by the first normalization coefficient to generate the normalized autocorrelation function of the window signal.

FIG. 12 is a functional block diagram of the second autocorrelation function generating unit 1030 illustrated in FIG. 10. Referring to FIG. 12, the second autocorrelation function generating unit 1030 includes a second inserting unit 1210, a third Fourier Transform unit 1220, a second power spectrum signal generating unit 1230, a fourth Fourier Transform unit 1240 and a second normalizing unit 1250. The second inserting unit 1210, the third Fourier Transform unit 1220, the second power spectrum signal generating unit 1230, the fourth Fourier Transform unit 1240 and the second normalizing unit 1250 of FIG. 12 perform the same functions as the first inserting unit 1110, the first Fourier Transform unit 1120, the first power spectrum signal generating unit 1130, the second Fourier Transform unit 1140 and the first normalizing unit 1150 of FIG. 11. However, the second autocorrelation function generating unit 1030 of FIG. 12 generates the normalized autocorrelation function of the windowed signal, while the first autocorrelation function generating unit 1020 of FIG. 11 generates the normalized autocorrelation function of the window signal.

The peak value determining unit 1050 of FIG. 10 determines the candidate pitches from the peak value of the normalized autocorrelation function of the windowed signal exceeding the fourth threshold value TH4 according to equation (8).

Referring to FIG. 9, the interpolating unit 920 receives the candidate pitch period of the determined candidate pitches and the period estimating value representing the length of the candidate pitch period and interpolates the candidate pitch period and the period estimating value. The interpolating unit 920 includes a period interpolating unit 924 and a period estimating value interpolating unit 928. The period interpolating unit 924 interpolates the period of the candidate pitch using equation (9) and the period estimating interpolating unit 928 interpolates the period estimating value corresponding to the period of the interpolated candidate pitch using equation (10).

The Gaussian distribution generating unit 930 includes a candidate pitch selecting unit 932 and a Gaussian distribution computing unit 934. The candidate pitch selecting unit 932 selects the candidate pitches having period estimating values greater than the first threshold value TH1 and the Gaussian distribution computing unit 934 computes the average and the variance of the selected candidate pitches to generate the Gaussian distributions of the candidate pitches of each frame.

The mixture Gaussian distribution generating unit 940 mixes the Gaussian distributions having distances smaller than the second threshold value TH2 among the generated Gaussian distributions according to equation (5) or equation (6) to generate the Gaussian distributions having new averages and variances. By mixing the Gaussian distributions having distances smaller than the second threshold value TH2 to generate one Gaussian distribution, the Gaussian distribution can be more accurately modeled.

The mixture Gaussian distribution selecting unit 950 selects at least one mixture Gaussian distribution having a likelihood exceeding the third threshold value TH3, which is determined by the histogram of the statistics of the generated Gaussian distributions. The likelihood of the mixture Gaussian distribution is computed using equation (7). By selecting the mixture Gaussian distribution having a likelihood exceeding the third threshold value TH3 with the mixture Gaussian distribution selecting unit 950, only the most reliable mixture Gaussian distribution remains.

The dynamic program executing unit 960 includes a distance computing unit 962 and a pitch tracking unit 964. The distance computing unit 962 computes the local distance for each frame of the speech signal. The local distance for the first frame of the speech signal is computed using equation (11) and the local distances for the remaining frames are computed using equation (12). The pitch tracking unit 964 tracks the path for which the sum of the local distances up to the final frame of the speech signal is largest using Measure(n,j)=Max i{Measure(n−1,i)+Dis2(n,j)} to track the final pitch of the final frame.

The additional candidate pitch reproducing unit 970 determines whether the candidate pitch exists in the sub-harmonic frequency range of the average frequency generated based on the average frequency and the variance of the selected mixture Gaussian distribution to generate the additional candidate pitch from the candidate pitch in the sub-harmonic frequency range having the largest period estimating value.

Figure 13:
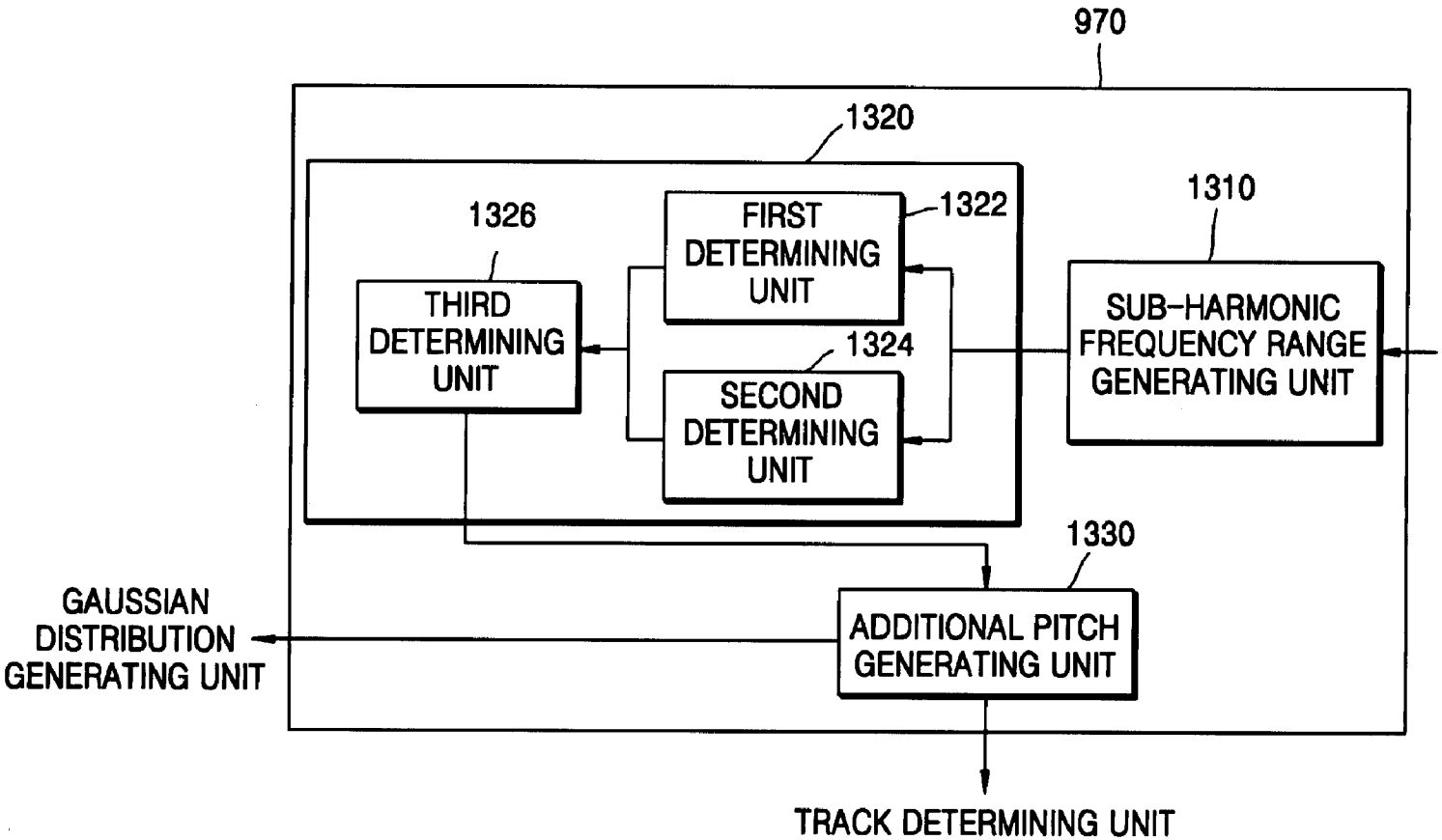
FIG. 13 is a functional block diagram of an additional candidate pitch reproducing unit illustrated in FIG. 9.

Referring to FIG. 13, the additional pitch reproducing unit 970 according to the present embodiment will now be described in detail.

The additional candidate pitch reproducing unit 970 includes a sub-harmonic frequency range generating unit 1310, a second candidate pitch determining unit 1320 and an additional candidate pitch generating unit 1330. The sub-harmonic frequency range generating unit 1310 divides the average frequency and the variance of the selected mixture Gaussian distribution by a predetermined number according to equation (13) to generate the sub-harmonic frequency range of the average frequency corresponding to each predetermined number.

The second candidate pitch determining unit 1320 includes a first determining unit 1322, a second determining unit 1324 and a determining unit 1326. The first determining unit 1322 determines whether the ratio of the frames including the candidate pitches which exist in the sub-harmonic frequency range is greater than the fifth threshold value TH5, and the second determining unit 1324 determines whether the average estimating value of the candidate pitches which exist in the sub-harmonic frequency range is greater than the sixth threshold value TH6. The determining unit 1326 determines that the candidate pitches exist in the generated sub-harmonic frequency range if the ratio of the frames is greater than the fifth threshold value and the average period estimating value is greater than the sixth threshold value based on the determining results of the first determining unit 1322 and the second determining unit 1324.

The additional candidate pitch generating unit 1330 multiplies the candidate pitch having the largest period estimating value among the candidate pitches in the sub-harmonic frequency range by the number generated by the sub-harmonic frequency range according to equation (14) to generate the additional candidate pitch.

Referring back to FIG. 9, the track determining unit 980 determines whether the pitch track of the speech signal is continuously repeated according to the tracking result of the pitch tracking unit 964 and whether the additional candidate pitch reproducing unit 970 reproduces the additional candidate pitch or not.

Figure 14:
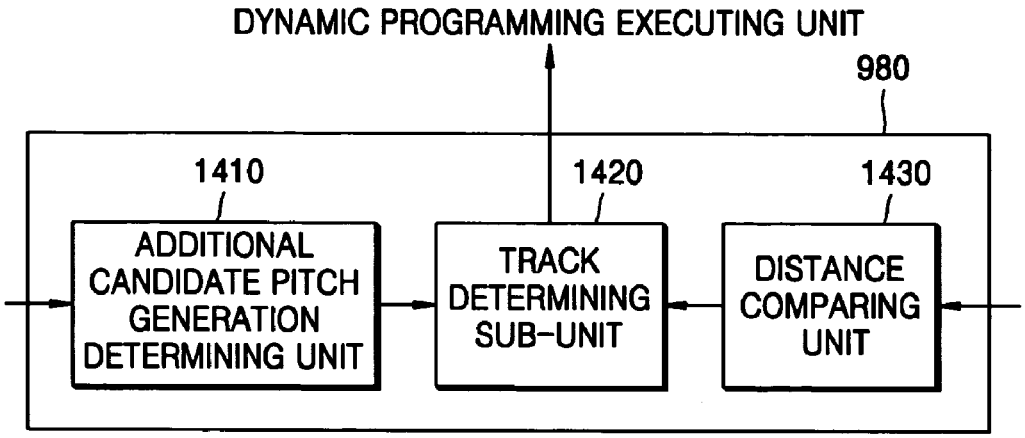
FIG. 14 is a functional block diagram of a track determining unit illustrated in FIG. 9.

Referring to FIG. 14, the track determining unit 980 will be described in detail.

The track determining unit 980 includes an additional candidate pitch production determining unit 1410, a track determining sub-unit 1420 and a distance comparing unit 1430. The additional candidate pitch production determining unit 1410 determines whether the additional candidate pitch is reproduced by the additional candidate pitch reproducing unit 970 and the distance comparing unit 1430 determines whether the sum of the local distances up to the final frame computed in the pitch tracking unit 964 is greater than the sum of the local distances up to the final frame which was previously computed. The track determining sub-unit 1420 determines whether the pitch track is being continuously repeated according to the determining results of the distance comparing unit 1430 and the additional candidate pitch production determining unit 1410.

FIG. 15 is a table comparing the capabilities of the pitch estimating method according to an embodiment of the present invention and a conventional method.

G.723 in the table indicates a method of estimating the pitch using G.723 encoding source code, YIN indicates a method of estimating the pitch using matlab source code published by Yin, CC indicates the simplest cross-autocorrelation type of a pitch estimating method, TK1 indicates a pitch estimating method in which DP is performed using only one Gaussian distribution, and AC indicates a method of performing interpolation using sin(x)/x and estimating the pitch using an autocorrelation function. Referring to the table, it is noted that the pitch estimating method according to the present invention has the lowest error ratio at 0.74%.

The above-described embodiments of the present invention can be written as computer programs and can be implemented in general-use digital computers that execute the programs using a computer readable recording medium. Examples of the computer readable recording medium include magnetic storage media (e.g., ROM, floppy disks, hard disks, etc.), optical recording media (e.g., CD-ROMs, or DVDs), and storage media.

The pitch estimating method and apparatus according to the above-described embodiments of the present invention can accurately estimate the pitch of audio signal by reproducing the candidate pitches which have been missed due to pitch doubling or pitch halving and can remove the windowing effect in the normalized autocorrelation function of a windowed signal. Also, by interpolating the period estimating value for the period of the candidate pitch using sin(x)/x, the pitch can be more accurately estimated.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A pitch estimating method comprising:

computing a normalized autocorrelation function of a windowed signal obtained by multiplying a frame of a speech signal by a window signal, and determining candidate pitches from a peak value of the normalized autocorrelation function of the windowed signal;

interpolating a period of the determined candidate pitches and an estimated candidate pitch value within the interpolated candidate pitch period;

generating Gaussian distributions for the candidate pitches for each frame for which the interpolated estimated candidate pitch value is greater than a first threshold value;

mixing the Gaussian distributions which are located at a distance less than a second threshold value to generate mixture Gaussian distributions and selecting at least one of the mixture Gaussian distributions that has a likelihood exceeding a third threshold value; and executing dynamic programming for the frames based on the candidate pitches of each of the frames and the selected mixture Gaussian distributions to estimate the pitch of each frame.

2. The method according to claim 1, wherein the computing the normalized autocorrelation function comprises:

dividing the speech signal into frames having a predetermined period and multiplying the divided frame signal by the window signal to generate the windowed signal;

normalizing the autocorrelation function of the window signal to generate normalized autocorrelation function of the window signal;

normalizing the autocorrelation function of the windowed signal to generate the normalized autocorrelation function of the windowed signal; and dividing the normalized autocorrelation function of the windowed signal by the normalized autocorrelation function of the window signal to generate a normalized autocorrelation function of the windowed signal in which a windowing effect is reduced.

3. The method according to claim 2, wherein the normalizing the autocorrelation function of the window signal comprises:

inserting 0 into the window signal;

performing a Fast Fourier Transform (FFT) on the window signal in which the 0 is inserted;

generating a power spectrum signal of the transformed window signal;

performing a Fast Fourier Transform (FFT) on the power spectrum signal to compute the autocorrelation function of the window signal; and dividing the autocorrelation function of the window signal by a first normalization coefficient to normalize the autocorrelation function of the window signal.

4. The method according to claim 2, wherein the normalizing the autocorrelation function of the windowed signal comprises:

inserting 0 into the windowed signal;

performing a Fast Fourier Transform (FFT) on the windowed signal in which the 0 is inserted;

generating a power spectrum signal of the transformed windowed signal;

performing a Fast Fourier Transform (FFT) on the power spectrum signal to compute the autocorrelation function of the windowed signal; and dividing the autocorrelation function of the windowed signal by a second normalization coefficient to normalize the autocorrelation function of the windowed signal.

5. The method according to claim 2, wherein the window signal is a function selected from the group consisting of a sine squared function, a hanning function and a hamming function.

6. The method according to claim 1, wherein the determining the candidate pitches comprises:

determining at least one value i for which the value of the autocorrelation function of the windowed signal exceeds a fourth threshold value; and selecting i satisfying $Rs(i-1)<Rs(i)>Rs(i+1)$, where RS(i) is the normalized autocorrelation function of the windowed signal, among the determined at least one value to determine the period of the candidate pitch from i.

7. The method according to claim 1, wherein the interpolating the period of the determined candidate pitches and the estimated candidate pitch value within the interpolated candidate pitch period comprises:

interpolating the period of the determined candidate pitches; and interpolating the estimated candidate pitch value within the interpolated period of the candidate pitches.

8. The method according to claim 7, wherein the period of the candidate pitches is interpolated using $$x = \tau + \frac{Rs(\tau+1) - Rs(\tau-1)}{2(2Rs(\tau) - Rs(\tau-1) - Rs(\tau+1))},$$

where RS(i) is the normalized autocorrelation function of the windowed signal, and wherein the estimated candidate pitch value within the interpolated period of the candidate pitches is interpolated using $$pr = \sum_{ix=i}^{I}\left\{Rs(ix)\times\frac{\sin[\pi(x-ix)]}{2\pi(x-ix)}\times\left[1+\cos\frac{\pi(x-ix)}{x-I+1}\right]\right\} + \sum_{ix=j}^{J}\left\{Rs(ix)\times\frac{\sin[\pi(ix-x)]}{2\pi(ix-x)}\times\left[1+\cos\frac{\pi(ix-x)}{J-x+1}\right]\right\},$$

where I and J are integers.

9. The method according to claim 1, wherein the generating the Gaussian distributions comprises:

selecting the candidate pitches that have a period estimating value greater than the first threshold value; and computing an average and a variance of the selected candidate pitches to generate the Gaussian distributions of the candidate pitches of each frame.

10. The method according to claim 1, wherein the mixing the Gaussian distributions comprises:

mixing the Gaussian distributions having a distance smaller than the second threshold value to generate the mixture Gaussian distributions with new averages and variances; and selecting at least one of the mixture Gaussian distributions that has a likelihood exceeding the third threshold value determined from a histogram of statistics of the Gaussian distributions.

11. The method according to claim 10, wherein the distance between the Gaussian distributions is computed using a JD divergence measuring method.

12. The method according to claim 1, wherein the executing the dynamic programming comprises:

computing a local distance between the frames of the speech signal, based on the candidate pitches of each of the frames of the speech signal and the selected mixture Gaussian distributions; and tracking a path by which a sum of local distances up to a final frame of the speech signal is largest to track the pitch of each of the frames.

13. The method according to claim 1, further comprising:

determining whether the candidate pitch exists in a subharmonic frequency range of an average frequency, the average frequency determined by an average and a variance of the selected mixture Gaussian distributions, the determining being performed after the executing of the dynamic programming; and reproducing an additional candidate pitch from the candidate pitch having the largest interpolated estimated candidate pitch value within the interpolated candidate pitch period, from among the candidate pitches in the sub-harmonic frequency range.

14. The method according to claim 13, wherein the determining whether the candidate pitch exists in the sub-harmonic frequency range of the average frequency and reproducing the additional candidate pitch comprises:

dividing the average frequency and the variance of the selected mixture Gaussian distributions by a predetermined number to generate a sub-harmonic frequency range corresponding to the predetermined number;

determining the candidate pitches which exist in the sub-harmonic frequency range; and multiplying the candidate pitch having the largest period estimating value among the candidate pitches in the sub-harmonic frequency range by the number generating the sub-harmonic frequency range to reproduce the additional candidate pitch.

15. The method according to claim 14, wherein the determining the candidate pitches that exist in the sub-harmonic frequency range comprises:

determining whether a ratio of the frames including the candidate pitches which exist in the sub-harmonic frequency range is greater than a fifth threshold value;

determining whether an average estimating value of the candidate pitches which exist in the sub-harmonic frequency range is greater than a sixth threshold value; and determining that the candidate pitches exist in the generated sub-harmonic frequency range if the ratio of the frames is greater than the fifth threshold value and the average period estimating value is greater than the sixth threshold value.

16. The method according to claim 13, further comprising:

repeating:

the mixing the Gaussian distributions and selecting at least one of the mixture Gaussian distributions, the executing dynamic programming, the determining whether the candidate pitch exists in the sub-harmonic frequency range, and the reproducing the additional candidate pitch until the sum of the local distances up to the final frame is not increased during the dynamic programming and no additional candidate pitches are generated.

17. A computer-readable recording medium encoded with processing instructions for causing a processor to execute a pitch estimating method, the method comprising:

computing a normalized autocorrelation function of a windowed signal obtained by multiplying a frame of a speech signal by a window signal and determining candidate pitches from a peak value of the normalized autocorrelation function of the windowed signal;

interpolating a period of the determined candidate pitches and an estimated candidate pitch value within the interpolated candidate pitch period;

generating Gaussian distributions for the candidate pitches for each frame for which the interpolated estimated candidate pitch value is greater than a first threshold value;

mixing the Gaussian distributions which are located at a distance less than a second threshold value to generate mixture Gaussian distributions and selecting at least one of the mixture Gaussian distributions that has a likelihood exceeding a third threshold value; and executing dynamic programming for the frames based on the candidate pitches of each of the frames and the selected mixture Gaussian distributions to estimate the pitch of each frame.

18. A pitch estimating apparatus comprising:

a first candidate pitch determining unit computing a normalized autocorrelation function of a windowed signal obtained by multiplying a frame of a speech signal by a window signal and determining candidate pitches from a peak value of the normalized autocorrelation function of the windowed signal;

an interpolating unit interpolating a period of the determined candidate pitches and an estimated candidate pitch value within the interpolated candidate pitch period;

a Gaussian distribution generating unit, causing at least one processor to generate Gaussian distributions for the candidate pitches for each frame for which the interpolated estimated candidate pitch value is greater than a first threshold value;

a mixture Gaussian distribution generating unit mixing the Gaussian distributions that have a distance smaller than a second threshold value to generate mixture Gaussian distributions;

a mixture Gaussian distribution selecting unit selecting at least one of the mixture Gaussian distributions that has a likelihood exceeding a third threshold value; and a dynamic programming executing unit executing dynamic programming for the frames based on the candidate pitches of each frame and the selected mixture Gaussian distributions to estimate the pitch of each frame.

19. The apparatus according to claim 18, wherein the first candidate pitch determining unit comprises:

an autocorrelation function computing unit dividing the speech signal into frames having a predetermined period and computing the autocorrelation function of the divided frame signal; and a peak value determining unit determining the candidate pitch for the frame signal from the peak value of the autocorrelation functions of the divided frame signal exceeding a predetermined fourth threshold value.

20. The apparatus according to claim 19, wherein the autocorrelation function computing unit comprises:

a windowed signal generating unit dividing the speech signal into the frames having a predetermined period and multiplying the divided frame signal by the window signal to generate the windowed signal;

a first autocorrelation function generating unit normalizing the autocorrelation function of the window signal to generate a normalized autocorrelation function of the window signal;

a second autocorrelation function generating unit normalizing the autocorrelation function of the windowed signal to generate the normalized autocorrelation function of the windowed signal; and a third autocorrelation function generating unit dividing the normalized autocorrelation function of the windowed signal by the normalized autocorrelation function of the window signal to generate a normalized autocorrelation function of the windowed signal in which the windowing effect is reduced.

21. The apparatus according to claim 20, wherein the first autocorrelation function generating unit comprises:

a first inserting unit inserting 0 into the window signal;

a first Fourier Transform unit performing a Fast Fourier Transform (FFT) on the window signal in which the 0 is inserted;

a power spectrum signal generating unit generating the power spectrum signal of the transformed window signal;

a second Fourier Transform unit performing a Fast Fourier Transform (FFT) on the power spectrum signal to compute the autocorrelation function of the window signal; and a first normalizing unit dividing the autocorrelation function of the window signal by a first normalization coefficient to normalize the autocorrelation function of the window signal.

22. The method according to claim 20, wherein the second autocorrelation function generating unit comprises:

a second inserting unit inserting 0 into the windowed signal;

a third Fourier Transform unit performing a Fast Fourier Transform (FFT) on the windowed signal in which the 0 is inserted;

a second power spectrum signal generating unit generating the power spectrum signal of the transformed windowed signal;

a fourth Fourier Transform unit performing a Fast Fourier Transform (FFT) on the power spectrum signal to compute the autocorrelation function of the windowed signal; and a second normalizing unit dividing the autocorrelation function of the windowed signal by a second normalization coefficient to normalize the autocorrelation function of the windowed signal.

23. The apparatus according to claim 20, wherein the window signal is a function selected from the group consisting of a sine squared function, a hanning function and a hamming function.

24. The apparatus according to claim 18, wherein the interpolating unit comprises:

a period interpolating unit interpolating the period of the determined candidate pitches; and a period estimating value interpolating unit interpolating the estimated candidate pitch values within the interpolated period of the candidate pitches.

25. The apparatus according to claim 24, wherein the period of the candidate pitch is interpolated using $$x = \tau + \frac{Rs(\tau+1) - Rs(\tau-1)}{2(2Rs(\tau) - Rs(\tau-1) - Rs(\tau+1))},$$

where RS(i) is the normalized autocorrelation function of the windowed signal, and wherein the estimated candidate pitch value within the interpolated period of the candidate pitches is interpolated using $$pr = \sum_{ix=i}^{I}\left\{Rs(ix) \times \frac{\sin[\pi(x-ix)]}{2\pi(x-ix)} \times \left[1 + \cos\frac{\pi(x-ix)}{x-I+1}\right]\right\} + \sum_{ix=j}^{J}\left\{Rs(ix) \times \frac{\sin[\pi(ix-x)]}{2\pi(ix-x)} \times \left[1 + \cos\frac{\pi(ix-x)}{J-x+1}\right]\right\},$$

where I and J are integers.

26. The apparatus according to claim 18, wherein the Gaussian distribution generating unit comprises:

a candidate pitch selecting unit selecting the candidate pitches that have a period estimating value greater than the first threshold value; and a Gaussian distribution computing unit computing the average and the variance for the selected candidate pitches to generate the Gaussian distributions of the candidate pitches of each frame.

27. The apparatus according to claim 18, wherein the single mixture Gaussian distribution generating unit computes the distance between the Gaussian distributions using a JD divergence measuring method.

28. The apparatus according to claim 18, wherein the dynamic programming executing unit comprises:

a distance computing unit computing the local distance between the frames of the speech signal, based on the candidate pitches of each of the frames of the speech signal and the selected mixture Gaussian distributions; and a pitch tracking unit tracking a path by which a sum of local distances up to a final frame of the speech signal is largest to track the pitch of each of the frames.

29. The apparatus according to claim 18, further comprising:

an additional candidate pitch reproducing unit, the additional candidate pitch reproducing unit determining whether the candidate pitch exists in a sub-harmonic frequency range of an average frequency, the average frequency determined by an average and a variance of the selected mixture Gaussian distributions, and reproducing an additional candidate pitch from the candidate pitch having the largest interpolated estimated candidate pitch value within the interpolated candidate pitch period, from among the candidate pitches in the sub-harmonic frequency range.

30. The apparatus according to claim 29, wherein the additional candidate pitch reproducing unit comprises:

a sub-harmonic frequency range generating unit dividing the average frequency and the variance of the selected mixture Gaussian distributions by a predetermined number to generate a sub-harmonic frequency range corresponding to the predetermined number;

a second candidate pitch determining unit determining the candidate pitches which exist in the sub-harmonic frequency range; and an additional candidate pitch generating unit multiplying the candidate pitch having the largest interpolated estimated candidate pitch value within the interpolated candidate pitch period, from among the candidate pitches in the sub-harmonic frequency range by the number generating the sub-harmonic frequency range to generate the additional candidate pitch.

31. The apparatus according to claim 30, wherein the second candidate pitch determining unit comprises:

a first determining unit determining whether the ratio of the frames including the candidate pitches which exist in the sub-harmonic frequency range is greater than a fifth threshold value;

a second determining unit determining whether the average estimating value of the candidate pitches which exist in the sub-harmonic frequency range is greater than a sixth threshold value; and a determining unit determining that the candidate pitches exist in the generated sub-harmonic frequency range if the ratio of the frames is greater than the fifth threshold value and the average period estimating value is greater than the sixth threshold value.

32. The apparatus according to claim 29, further comprising:

a tracking determining unit, the tracking determining unit repeating, for every frame, the pitch tracking of the speech signal based on the output values of the dynamic programming executing unit and the additional candidate pitch reproducing unit.

33. The apparatus according to claim 32, wherein the tracking determining unit comprises:

a distance comparing unit determining whether the sum of the local distances up to the final frame computed in the dynamic programming executing unit is greater than the sum of the local distances, up to the final frame computed in the dynamic programming executing unit;

an additional candidate pitch production determining unit determining whether an additional candidate pitch is reproduced by the additional candidate pitch reproducing unit; and a track determining sub-unit determining whether a pitch track is repeated for every frame, according to the output of the distance comparing unit and the additional candidate pitch production determining unit.

* * * * *

UNITED STATES PATENT AND TRADEMARK OFFICE

CERTIFICATE OF CORRECTION

PATENT NO. : 7,672,836 B2
APPLICATION NO. : 11/247277
DATED : March 2, 2010
INVENTOR(S) : Yongbeom Lee et al.

It is certified that error appears in the above-identified patent and that said Letters Patent is hereby corrected as shown below:

Column 15, Line 64, change "RS(i)" to --Rs(i)--.

Column 16, Line 17, change "RS(i)" to --Rs(i)--.

Column 19, Lines 42-44, change
"wherein the period of
the candidate pitch is interpolated using" to
--wherein the period of the candidate pitch is interpolated using--.

Column 19, Line 50, change "RS(i)" to --Rs(i)--.

Column 20, Line 8, change "the single" to --the--.

Signed and Sealed this

First Day of June, 2010

David J. Kappos

David J. Kappos
*Director of the United States Patent and Trademark Office*